US005122430A

United States Patent [19]

Nishitsuji et al.

[11] Patent Number: 5,122,430

[45] Date of Patent: Jun. 16, 1992

[54] THREE-DIMENSIONAL IMAGE FORMING METHOD

[75] Inventors: Tetsuro Nishitsuji, Kanagawa; Shigeo Honma, Osaka, both of Japan

[73] Assignee: Minolta Camera Kabushiki Kaisha, Osaka, Japan

[21] Appl. No.: 458,232

[22] Filed: Dec. 28, 1989

[30] Foreign Application Priority Data

Dec. 29, 1988 [JP] Japan ..... 63-334154
Dec. 29, 1988 [JP] Japan ..... 63-334155

[51] Int. Cl.[5] ..... G03G 9/00
[52] U.S. Cl. ..... 430/110; 430/106
[58] Field of Search ..... 430/106, 110

[56] References Cited

U.S. PATENT DOCUMENTS 2,825,282 3/1958 Gergen et al. ..... 101/401.3
3,088,402 5/1963 Newman .
4,006,267 2/1977 Kurz et al. .
4,871,408 10/1989 Honma et al. ..... 428/209 X
4,965,162 10/1990 Aonuma et al. ..... 430/110

FOREIGN PATENT DOCUMENTS 56-92544 12/1979 Japan .
55-101954 8/1980 Japan .
59-35359 8/1984 Japan .

*Primary Examiner*—Marion E. McCamish
*Assistant Examiner*—Stephen C. Crossan
*Attorney, Agent, or Firm*—Burns, Doane, Swecker & Mathis

[57] ABSTRACT

The invention provides a three-dimensional image forming method which comprises the steps of forming a desirable image on an image recording material including a thermoexpansive material by using an image forming material including an infrared rays absorbing agent or metal aluminum fine particles, said infrared rays absorbing agent containing tin oxide, antimony oxide and/or indium oxide; and applying heat selectively to the desirable image area formed on said recording material, whereby the desirable image-existing area is protruded to effect the three-dimensional image recording.

11 Claims, 4 Drawing Sheets

THREE-DIMENSIONAL IMAGE FORMING METHOD

BACKGROUND OF THE INVENTION

1. Field of the Invention

This invention relates to a three-dimensional image (hereinafter referred to as 3-D image) forming method on thermally expansible sheets.

2. Description of the Related Art

As set forth in Japanese Examined Patent Publication (KOKOKU) No. 35359/1984, the following 3-D image forming method has been known: A predetermined image is formed on a thermally expansible sheet with an image forming material of a high light absorbing ability, and light is irradiated on the thermally expansible sheet. Then, only the image portions are selectively heated and protruded by the difference in the light absorbing abilities. Whereby the 3-D image has been formed.

The conventional 3-D image forming method employs the image forming material which satisfies the high light absorbing ability requirement. The 3-D image forming method accordingly employs a black or brown image forming material. Therefore, no 3-D image can be obtained when the predetermined image is formed on the thermally expansible sheet with a red, blue, green or yellow image forming material. This is because such image forming material has low light absorbing abilities.

When one desires to color the 3-D image thus obtained, foils of a desired color are transferred on the 3-D image portions However, the number of the operation processes increases and the operation becomes complicated because the transferring should be done after the 3-D image forming. In addition, when the color foils are transferred on the image portions in black without completely covering the neighboring portions of the image portions, the appearance of the 3-D image deteriorates because the color of the thermally expansible sheet is exposed.

SUMMARY OF THE INVENTION

This invention has been developed in view of the above-mentioned problems.

The object of the invention is to provide a 3-D image forming method by using an image forming material capable of absorbing the energy of light and generating heat.

Another object of the invention is to provide a 3-D color image forming method for the formation of clear color images by a simple process.

Another object of the invention is to provide a 3-D color image forming method by using color developer of an electrophotographic method.

The present invention is achieved by providing a three-dimensional image forming method which comprises the steps of forming a desirable image on an image recording material including a thermoexpansive material by using an image forming material including an infrared rays absorbing agent or metal aluminum fine particles, said infrared rays absorbing agent containing tin oxide, antimony oxide and/or indium oxide; and applying heat selectively to the desirable image area formed on said recording material, whereby the desirable image-existing area is protruded to effect the three-dimensional image recording.

DETAILED DESCRIPTION OF THE PREFERRED EMBODIMENTS

The present invention relates to a three-dimensional image forming method which comprises the steps of forming a desirable image on an image recording material including a thermoexpansive material by using an image forming material including an infrared rays absorbing agent or metal aluminum fine particles, said infrared rays absorbing agent containing tin oxide, antimony oxide and/or indium oxide; and applying heat selectively to the desirable image area formed on said recording material, whereby the desirable image-existing area is protruded to effect the three-dimensional image recording.

The infrared rays absorbing agent according to this invention absorbs the energy of light and generates heat when it is subjected to light irradiation. The infrared rays absorbing agent according to this invention gradually heats the vehicles around itself. Thus, the image forming material according to this invention in which the infrared rays absorbing agent is compounded is put into an exothermic state entirely.

The vehicle means a component, and mainly comprises organic material.

Another image forming material comprises the metal aluminum fine particles. Whereby the image forming material absorbs the energy of light and generates heat when it is subjected to light irradiation. Thus, when a predetermined image is formed on a thermally expansible sheet with the image forming material, and light is irradiated on the thermally expansible sheet, portions of the thermally expansible sheet corresponding only to the formed predetermined image can be selectively heated and protruded.

The image forming material which includes the metal aluminum fine particles generates heat, because the light repeatedly undergoes irregular reflection among the metal aluminum fine particles of an innumerable number so that the length of the light path is believed to be prolonged. In other words, because the irregular reflection has the light travel repeatedly in the vehicle or the organic material of a small heat rays absorbing ability, the light is absorbed gradually, and most of the light energy has been absorbed by the image forming material before the light goes out of the image forming material which in turn causes the image forming material to generate heat. Here, note that the metal aluminum fine particles have a small light absorbing ability.

Figure 1:
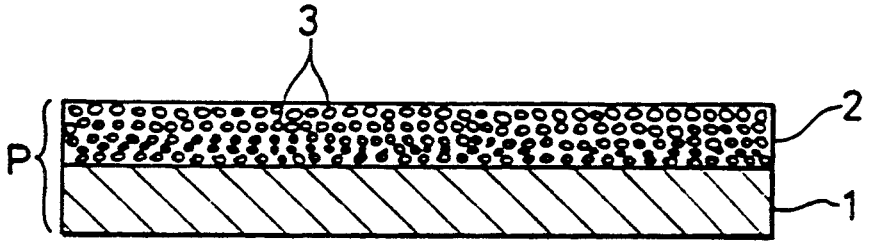
FIG. 1 is an enlarged sectional view showing the construction of a thermoexpansive sheet.

FIG. 1 is a sectional view explanatory of the construction of an image recording material P. In the same figure, the reference numeral 1 denotes a base sheet formed of a material having rigidity enough to prevent expansion of the back side of the base sheet when later-described thermoexpansive microspheres expand on heating, and which material does not soften at a temperature at which the microspheres expand. Examples of such material include paper, synthetic paper, synthetic resin sheet, plywood and metal foil.

Numeral 2 denotes a coating layer formed by applying thermoexpansive microspheres 3 of 5 to 30 $\mu$ in particle diameter onto the base sheet 1 together with a binder of a thermoplastic resin such as, for example, vinyl acetate resin, acrylic acid ester resin, methacrylic acid ester resin, or styrene-butadiene resin, followed by drying. The thermoexpansive microspheres 3 are each formed by encapsulating propane, butane or any other low boiling, vaporizable substance into a microcapsule of a thermoplastic resin such as vinylidene chloride—acrylonitrile copolymer, methacrylic acid ester—acrylonitrile copolymer, or vinylidene chloride—acrylic acid ester copolymer. The thermo expansive microspheres 3 may also comprise a granular, heat-sensitive, organic foaming agent such as azobisisobutyronitrile.

Three-dimensional images are formed in the following manner.

Figure 2A:
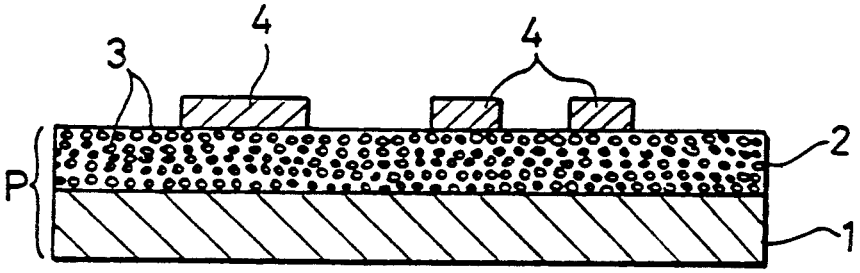
FIG. 2 (*a*) and (*b*) are explanatory views of three-dimensional image processing steps using the thermoexpansive sheet shown in FIG. 1.
Figure 2B:
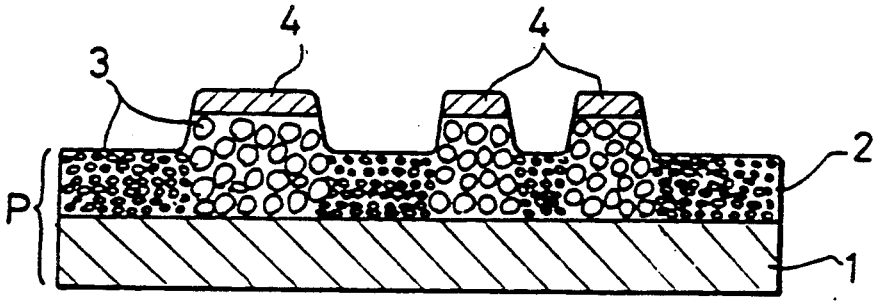

First, desirable images 4 are formed onto the image recording material P (hereinafter referred to as the "sheet P" using image forming material of the present invention. FIG. 2 (*a*) shows a section of the sheet P with desirable images 4 formed thereon.

Figure 3:
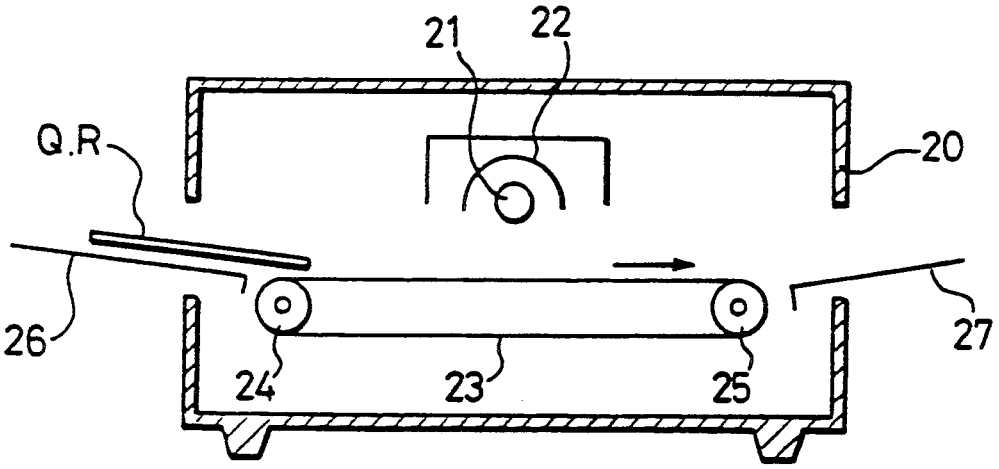
FIG. 3 is a sectional view showing a main construction of a light irradiator.

Next, the sheet is irradiated with light. An example of a light irradiator is shown in FIG. 3. In a housing 20 there is provided an illuminant lamp 21 such as a halogen lamp in an upper position below a reflecting mirror 22. Below the illuminant lamp 21 there is disposed a conveyor belt 23 formed of a metal or any other heat-resistant material, which is stretched between a driving pulley 24 and a driven pulley 25 and moves in the direction of the arrow by means of a drive source (not shown). Numerals 26 and 27 denote a paper feed tray and a paper discharge tray, respectively.

The conveyor belt 23 is started by applying power and the illuminant lamp 21 is turned ON. Then, the sheet P is advanced so that the desirable images 4 formed thereon is opposed to the lamp 21. The sheet P is irradiated with light under the illuminant lamp 21, whereupon the desirable images 4, formed by image forming material of the present invention, absorb light energy and are heated thereby, so that the coating layer 2 underlying the desirable images 4 is heated. As a result, the microspheres 3 in this area expand rapidly to raise the corresponding portions of the coating layer 2.

FIG. 2 (*b*) shows the section of the sheet P after completion of the irradiation.

Having generally described this invention, a further understanding can be obtained by reference to certain specific preferred embodiments which are provided herein for purposes of illustration only and are not intended to be limiting unless otherwise specified.

First Preferred Embodiment

This preferred embodiment is an example of a red crayon comprising an infrared rays absorbing agent and constituting an image forming material. This red crayon "A" comprised a mixture of 100 parts by weight of a conventional red crayon "B" (produced by Miyazaki Kogyo Co., Ltd.) and 5 parts by weight of tin oxide containing antimony (produced by Sumitomo Cement Co., Ltd.). The conventional red crayon "B" comprised 50 parts by weight of wax comprising Japan wax, saturated and unsaturated fatty acids and ester thereof, 35 parts by weight of pigment comprising talc, clay and titanium oxide, and 15 parts by weight of coloring material comprising a mixture of red #202 (litholbin "BCA") and red #204 (lake red "BCA"). This composition is set forth in Table 1.

TABLE 1

| | 1st. Pref. | 2nd. Pref. | Conventional One | |
|---|---|---|---|---|
| Component | Embodiment Crayon "A" (red) | Embodiment Crayon "C" (yellow) | Crayon "B" (red) | Crayon "B" (yellow) |
| Wax | 50 | 50 | 50 | 50 |
| Pigment | 35 | 25 | 35 | 25 |
| Coloring | 15 | 25 | 15 | 25 |
| Material | 5 | 10 | None | None |
| Infrared Absorbing Agent | Tin Oxide Containing Antimony | Indium Oxide Containing Tin | | |

(Unit: Parts by Weight)

The red crayon "A" of this preferred embodiment was produced as follows. The wax, pigment, coloring material, and infrared rays absorbing agent were compounded in the above-mentioned proportions, and heated. The wax was then fluidized to make a uniform mixture. The molten mixture was poured in a mold, and cooled therein. After the cooling, a product was taken out of the mold, and the red crayon "A" of this preferred embodiment was obtained.

A three-dimensional image was formed on a thermally expansible sheet (produced by Minolta Jimuki Hanbai Co., Ltd.) by using the red crayon "A". The thermally expansible sheet comprised a sheet-shaped substrate and a thermally expansible layer comprising thermally expansible microspheres disposed on the surface of the sheet-shaped substrate. A predetermined image was formed manually on the thermally expansible sheet with the red crayon "A". Then, light was irradiated on the thermally expansible sheet with a light irradiation apparatus (produced by Minolta Jimuki Hanbai Co., Ltd.). Only the portions on the thermally expansible sheet corresponding to the image were protruded accordingly, and thereby a 3-D image was formed favorably. The favorable 3-D image was formed, because the red crayon "A", in which tin oxide containing antimony was compounded, absorbed the energy of the light, and generated heat. The thermally expansible microspheres were heated and expanded by the generated heat, and thereby the thermally expansible layer was protruded to make the 3-D image. On the contrary, no 3-D image was formed on the thermally expansible sheet on which the image was formed similarly with the conventional red crayon "B".

Figure 4:
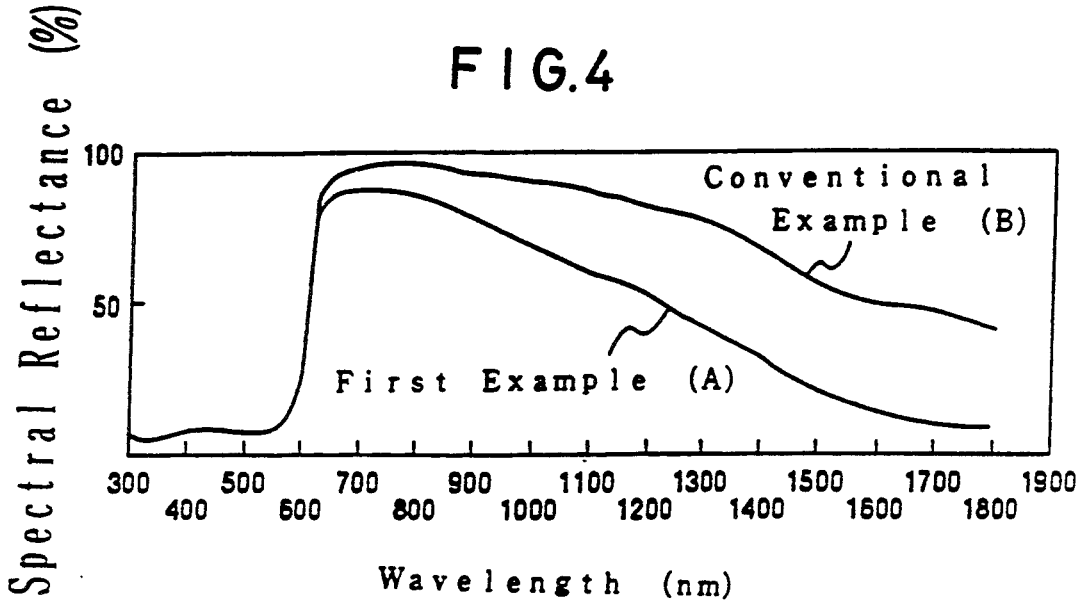
FIG. 4 is a graph showing the results of measurement on the spectral reflectance of a red crayon of a first preferred embodiment according to this invention and a conventional red crayon.

The spectral reflectance of the red crayon "A" of this preferred embodiment and the conventional crayon "B" were then measured with a spectrophotometer (type "340" automatic recording spectrophotometer produced by Hitachi Seisakusho Co., Ltd.). The results of the measurement are illustrated in FIG. 4. It was understood from FIG. 4 that the red crayon "A" of this preferred embodiment showed decreased reflectances in the near infrared region (650 to 1800 nm) and had a better light absorbing ability than the conventional red crayon "B" had. It was thus confirmed that the tin oxide containing antimony compound in the red crayon "A" of this preferred embodiment contributed to the good light absorbing ability, and that the tin oxide containing antimony was an effective infrared rays absorbing agent.

Second Preferred Embodiment

This preferred embodiment is an example of a yellow crayon. This yellow crayon "C" comprised a mixture of 100 parts by weight of a conventional yellow crayon "D" (produced by Miyazaki Kogyo Co., Ltd.) and 10 parts by weight of indium oxide containing tin (produced by Sumitomo Cement Co., Ltd.). The conventional yellow crayon "D" comprised 50 parts by weight of wax comprising Japan wax, saturated and unsaturated fatty acids, 25 parts by weight of pigment comprising talc, clay and titanium oxide, and 25 parts by weight of coloring material comprising yellow #4 (a mixture of tartrazine and titanium oxide). This composition is set forth in Table 1.

The yellow crayon "C" of this preferred embodiment was produced in a manner similar to the production method described in the section of "First Preferred Embodiment".

An image was formed on a thermally expansible sheet by using the yellow crayon "C" and the conventional yellow crayon "D" in a manner similar to the method described in the section of "First Preferred Embodiment". The images were irradiated with light by the light irradiation apparatus. No 3-D image was formed with the conventional yellow crayon "D", while a favorable 3-D image was formed with the yellow crayon "C" of this preferred embodiment.

Figure 5:
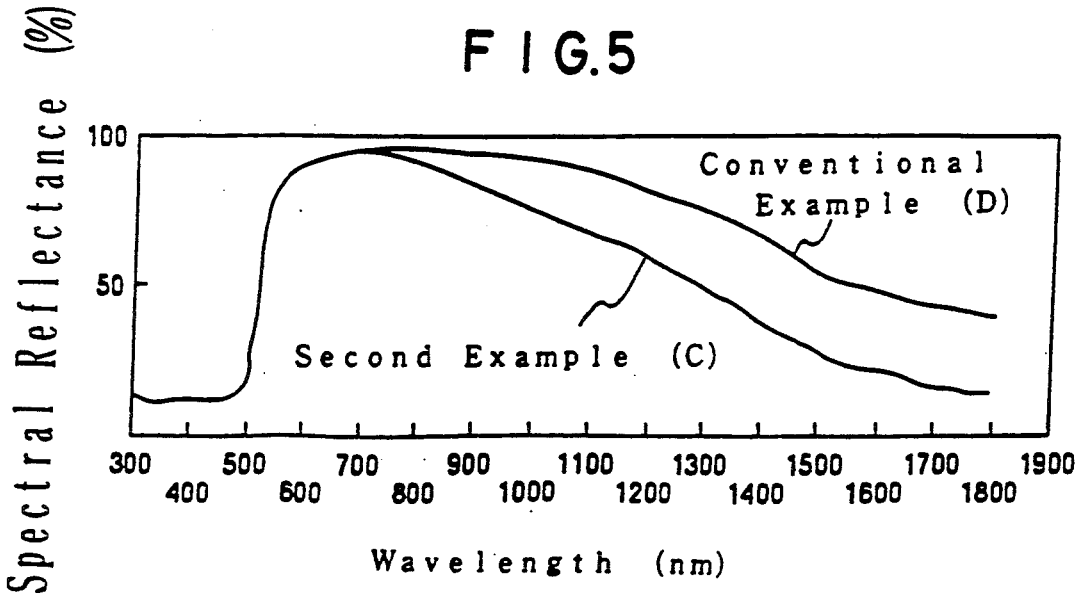
FIG. 5 is a graph showing the results of measurement on the spectral reflectance of a yellow crayon of a second preferred embodiment according to this invention and a conventional yellow crayon.

The spectral reflectance of the yellow crayon "C" of this preferred embodiment and the conventional yellow crayon "D" were then measured with the spectrophotometer in a manner similar to the method described in the section of "First Preferred Embodiment". The results of the measurement are illustrated in FIG. 5. It was understood from FIG. 5 that the yellow crayon "C" of this preferred embodiment showed decreased reflectance in the near infrared region (700 to 1800 nm) and had a better light absorbing ability than the conventional yellow crayon "D" had. It was thus confirmed that the indium oxide containing tin, compounded in the yellow crayon "C" of this preferred embodiment, contributed to the good light absorbing ability, and that the indium oxide containing tin was an effective infrared rays absorbing agent.

Third Preferred Embodiment

This preferred embodiment is an example of a red printing ink as the image forming material.

The red printing ink of this preferred embodiment comprised 100 parts by weight of a conventional red printing ink comprising the following vehicles and coloring agents, and 5 parts by weight of indium oxide containing tin as the infrared rays absorbing agent. The red printing ink of this preferred embodiment was produced by compounding and uniformly dispersing the infrared rays absorbing agent in the conventional deep red printing ink.

The composition of the conventional red printing ink was as follows:

Brilliant carmine "6B"; 5% by weight
Clay; 35% by weight
Ethyl hydroxyethyl cellulose (EHEC); 5% by weight
Pentaerythritol ester of rosin; 10% by weight
Mineral spirit; 20% by weight
Solvent #100 (aromatic hydrocarbon solvent); 20% by weight
Cellosolve; 5% by weight, A predetermined image was printed on the thermally expansible sheet by a screen printing method with the red printing ink of this preferred embodiment. After drying the red printing ink of this preferred embodiment, the light was irradiated on the thermally expansible sheet with the light irradiation apparatus. The image portions, formed with the red printing ink of this preferred embodiment, on the thermally expansible sheet with protruded, and a 3-D image in red was formed vividly. On the other hand, no 3-D image was formed when the image was formed similarly with the conventional red printing ink free from the infrared rays absorbing agent.

Fourth Preferred Embodiment

This preferred embodiment is an example of a deep blue printing ink as the image forming material.

The deep blue printing ink of this preferred embodiment comprised 100 parts by weight of a conventional deep blue printing ink comprising the following vehicles and coloring agents, and 3 parts by weight of tin oxide containing antimony as the infrared rays absorbing agent. The deep blue printing ink of this preferred embodiment was produced by compounding and uniformly dispersing the infrared rays absorbing agent in the conventional deep blue printing ink.

The composition of the conventional deep blue printing ink was as follows:

Beta type phthalocyanine blue; 3% by weight
Rutile type titanium dioxide; 25% by weight
Copolymer resin of vinyl chloride and vinyl acetate; 20% by weight
Acrylic resin; 5% by weight
Cyclohexane; 10% by weight
Solvent #100 (aromativ hydrocarbon solvent); 33% by weight
Isophorone; 3% by weight
Dioctyl phthalate (DOP); 1% by weight.

A predetermined image was printed on the thermally expansible sheet in a manner similar to the above-described third preferred embodiment with the deep blue printing ink of this preferred embodiment. After drying the deep blue printing ink of this preferred embodiment, the light was irradiated on the thermally expansible sheet with the light irradiation apparatus. Only the image portions, formed with the deep blue printing ink of this preferred embodiment, on the thermally expansible sheet were protruded, and a 3-D image in deep blue was formed vividly. On the other hand, no 3-D image was formed when the image was formed similarly with the conventional deep blue printing ink free from the infrared rays absorbing agent.

Fifth Preferred Embodiment

This preferred embodiment is an example of painting colors as the image forming material.

The painting color of this preferred embodiment comprised 100 parts by weight of a commercially available emerald green painting color, "Liquitex (produced by Sony Corp.)", and 3 parts by weight of indium oxide containing tin as the infrared rays absorbing agent. The emerald green painting color of this preferred embodiment was produced by compounding and uniformly dispersing the infrared rays absorbing agent in the emerald green painting color.

A predetermined image was formed on the thermally expansible sheet with the emerald green painting color of this preferred embodiment. After drying the emerald green painting color of this preferred embodiment, the light was irradiated on the thermally expansible sheet with the light irradiation apparatus. Only the image portions, formed with the emerald green painting color of this preferred embodiment, on the thermally expansible sheet were protruded, and a 3-D in emerald green was formed vividly. On the other hand, no 3-D image was formed when the image was formed similarly with the conventional emerald green painting color free from the infrared rays absorbing agent.

Further, other examples of painting colors of this preferred embodiment were produced by compounding indium oxide containing tin or tin oxide containing antimony in conventional painting colors of different colors, namely cobalt blue and yellow mediumane painting colors (produced by Sony Corp.). The images formed with the other examples of painting colors of this preferred embodiment were similarly protruded to form the 3-D images in respective colors.

Sixth Preferred Embodiment

This preferred embodiment is an example of a white toner used for a developing agent of an electrophotographic method.

The white toner of this preferred embodiment comprised the following components and indium oxide containing tin as the infrared rays absorbing agent was compounded by from 0.5 to 5 parts by weight therein.

The composition of the white toner was as follows:

- Copolymer resin of styrene and acrylic resin; 100 parts by weight
- Titanium oxide (white pigment); 30 parts by weight
- Indium oxide containing tin; from 0.5 to 5 parts by weight
- Low molecular weight polypropylene; 2.5 parts by weight
- Quarternary ammonium; 2 parts by weight
- Copolymer resin of styrene and amino acrylic resin; 6 parts by weight.

Four kinds of white toners of this preferred embodiment were prepared by varying the content of indium oxide containing tin from 0.5 parts by weight, 1.0 part by weight, and 2.0 parts by weight to 5.0 parts by weight. A predetermined image was formed on the thermally expansible sheets with these white toners, and made into the 3-D image. The protrusion height and color tone of the 3-D image were then evaluated. An electrophotographic copying machine (produced by Minolta Co., Ltd.) was used when forming the predetermined image, and the image was thereafter made into the 3-D with the light irradiating apparatus.

A white toner free from indium oxide containing tin was prepared as Comparative Example No. 1, and toner with carbon black compounded by 1.0 parts by weight instead of indium oxide containing tin were prepared as Comparative Example No. 2. Similarly, the predetermined image formed by the toner of Comparative Example Nos. 1 and 2 were irradiated with light, and the protrusion height and the color tone of the 3-D image were thereafter evaluated.

TABLE 2

(White Toner)

| | Content of Indium Oxide Containing Tin (Parts by Weight) | Protrusion Height (mm) | Color Tone |
|---|---|---|---|
| 6th Pref. Embodi. | 0.5 | 0.5 | Vivid white reproduced. |
| | 1.0 | 0.7 | Vivid white reproduced. |
| | 2.0 | 0.85 | Vivid white reproduced. |
| | 5.0 | 0.9 | Slightly uncleare, but substantially identical with the original color. |
| Compara. Example No. 1 | 0 | 0 | Vivid white |
| Compara. Example No. 2 | 1.0 Carbon Black | 0.85 | Turned into gray, and no white reproduced. |

As set forth in Table 2, the images were protruded sufficiently in the protrusion heights of from 0.5 to 0.85 nm and the color thereof was reproduced vividly and free from unclearness when the indium oxide containing tin was compounded in the white toner by 0.5 parts by weight, 1.0 part by weight and 2.0 parts by weight. The protrusion height was 0.9 mm and the 3-D image was formed in a white, slightly unclear but substantially identical with the original color when the indium oxide containing tin was compounded in the white toner by 5.0 parts by weight.

On the contrary, the color of the image was reproduced vividly in white, but no image was protruded and no 3-D image was formed when the image was formed with the white toner of Comparative Example No. 1. Further, the image was protruded by the protrusion height of 0.85 mm enabling a satisfactory 3-D image formation, but the color of the 3-D image was turned into gray and no original white was reproduced when the image was formed with the white toner of Comparative Example No. 2.

Seventh Preferred Embodiment

This preferred embodiment is an example of a red toner used for a developing agent of an electrophotographic method.

The red toner of this preferred embodiment comprised the following components and indium oxide containing tin as the infrared rays absorbing agent was compounded by from 0.5 to 5 parts by weight therein.

The composition of the red toner was as follows:

- Copolymer resin of styrene and acrylic resin; 100 parts by weight
- Red pigment, Lithol Scarlet D3700 (produced by BASF Co., Ltd.); 5 parts by weight
- Indium oxide containing tin (infrared rays absorbing agent); from 0.5 to 5 parts by weight Low molecular weight polypropylene; 2 parts by weight Copolymer resin of styrene and amino acrylic resin; 1 part by weight.

Four kinds of red toners of this preferred embodiment were prepared by varying the content of indium oxide containing tin from 0.5 part by weight, and 1.0 parts by weight, 2.0 parts by weight to 5.0 parts by weight. A predetermined image was formed on the thermally expansible sheets with these red toners, and made into the 3-D image. The protrusion height and color tone of the 3-D image were then evaluated. The predetermined image was formed and made into the 3-D image with the same apparatuses and in the same manner as described in the section of "Sixth Preferred Embodiment".

A red toner free from indium oxide containing tin was prepared as Comparative Example No. 3, and a toner with carbon black compounded by 1.0 part by weight instead of indium oxide containing tin was prepared as Comparative Example No. 4. Similarly, the predetermined image formed by the toner of Comparative Example Nos. 3 and 4 were irradiated with light, and the protrusion height and the color tone of the 3-D image were thereafter evaluated.

TABLE 3

(Red Toner)

| | Content of Indium Oxide Containing Tin (Parts by Weight) | Protrusion Height (mm) | Color Tone |
|---|---|---|---|
| 7th Pref. Embodi. | 0.5 | 0.5 | Vivid red reproduced. |
| | 1.0 | 0.7 | Vivid red reproduced. |
| | 2.0 | 0.85 | Vivid red reproduced. |
| | 5.0 | 0.9 | Vivid red reproduced. |
| Compara. Example No. 3 | 0 | 0 | Vivid red |
| Compara. Example No. 4 | 1.0 Carbon Black | 0.85 | Red uncleare with black |

As set forth in Table 3, the images were protruded sufficiently in the protrusion heights of from 0.5 to 0.9 mm and the color thereof was reproduced int he original color vividly and free from unclearness when the indium oxide containing tin was compounded in the white toner by 0.5 by weight, 1.0 part by weight, 2.0 parts by weight and 5.0 parts by weight.

On the contrary, the color of the image was reproduced vividly in red, but no image was protruded and no 3-D image was formed when the image was formed with the red toner of Comparative Example No. 3. Further, the image was protruded by the protrusion height of 0.85 mm enabling a satisfactory 3-D image formation, but the color of the 3-D image was unclear with black when the image was formed with the red toner of Comparative Example No. 4.

Eighth Preferred Embodiment

This preferred embodiment is an example of a blue toner used for a developing agent of an electrophotographic method.

The blue toner of this preferred embodiment comprised the following components and tin oxide containing antimony as the infrared rays absorbing agent was compounded by from 0.5 to 5 parts by weight therein.

The composition of the red toner was as follows:

Copolymer resin of styrene and acrylic resin; 100 parts by weight

Blue pigment, Heltogen Blue L7020 (produced by BASF Co., Ltd.); 5 parts by weight Tin oxide containing antimony (infrared rays absorbing agent); from 0.5 to 5 parts by weight Low molecular weight polypropylene; 2 parts by weight Copolymer resin of styrene and amino acrylic resin; 1 part by weight.

Four kinds of blue toner of this preferred embodiment were prepared by varying the content of tin oxide containing antimony from 0.5 part by weight, and 1.0 parts by weight, 2.0 parts by weight to 0.5 parts by weight. A predetermined image was formed on the thermally expansible sheets with these red toners, and made into the 3-D image. The protrusion height and color tone of the 3-D image were then evaluated. The predetermined image was formed and made into the 3-D image with the same apparatuses and in the same manner as described in the section of "Sixth Preferred Embodiment".

A blue toner free from tin oxide containing antimony was prepared as Comparative Example No. 5, and a toner with carbon black compounded by 1.0 part by weight instead of tin oxide containing antimony was prepared as Comparative Example No. 6. Similarly, the predetermined image formed by the toner of Comparative Example Nos. 5 and 6 were irradiated with light, and the protrusion height and the color tone of the 3-D image were thereafter evaluated.

TABLE 4

(Blue Toner)

| | Content of Tin Oxide Containing Antimony (Parts by Weight) | Protrusion Height (mm) | Color Tone |
|---|---|---|---|
| 8th Pref. Embodi. | 0.5 | 0.5 | Vivid blue reproduced. |
| | 1.0 | 0.7 | Vivid blue reproduced. |
| | 2.0 | 0.75 | Vivid blue reproduced. |
| | 5.0 | 0.9 | Vivid blue reproduced. |
| Compara. Example No. 5 | 0 | 0.1 | Vivid blue |
| Compara. Example No. 6 | 1.0 Carbon Black | 0.9 | Blue uncleare with black |

As set forth in Table 4, the images were protruded sufficiently in the protrusion heights of from 0.5 to 0.9 mm and the color thereof was reproduced in the original color vividly and free from unclearness when the tin oxide containing antimony was compounded in the white toner by 0.5 parts by weight, 1.0 parts by weight, 2.0 parts by weight and 5.0 parts by weight.

On the contrary, the color of the image was reproduced vividly in blue, but the image was protruded only by 0.1 mm and nor 3-D image was formed virtually when the image was formed with the blue toner of Comparative Example No. 5. Further, the image was protruded by the protrusion height of 0.9 mm enabling a satisfactory 3-D image formation, but the color of the 3-D image was unclear with black when the image was formed with the blue toner of Comparative Example No. 6.

Ninth Preferred Embodiment

This preferred embodiment is an example of an infrared rays absorbing toner superior in the infrared rays absorbing property.

The infrared rays absorbing toner of this preferred embodiment comprised the following components and indium oxide containing tin as the infrared rays absorbing agent was compounded by 5 parts by weight therein.

The composition of the infrared rays absorbing toner was as follows:

Copolymer resin of styrene and acrylic resin; 100 parts by weight

Indium oxide containing tin (infrared rays absorbing agent); 5 parts by weight

Low molecular weight polypropylene; 2 parts by weight

Copolymer resin of styrene and amino acrylic resin; 1 part by weight.

When mixed with desired color toners, the infrared rays absorbing toner of this preferred embodiment can be used as an image forming material for forming 3-D images on thermally expansible sheets.

Three kinds of image forming materials were prepared by mixing infrared rays absorbing toners of this preferred embodiment by 5 parts by weight, 10 parts by weight and 20 parts by weight with a red toner having the following composition. A predetermined image was formed on the thermally expansible sheets with these image forming materials, and made into the 3-D image. The protrusion height and color tone of the 3-D image were then evaluated. The predetermined image was formed and made into the 3-D image with the same apparatuses and in the same manner as described in the section of "Sixth Preferred Embodiment".

The composition of the red toner was as follows:

Copolymer resin of styrene and acrylic resin; 100 parts by weight

Red pigment, Lithol Scarlet D3700 (produced by BASF Co., Ltd.); 5 parts by weight Low molecular weight polypropylene; 2 parts by weight Copolymer resin of styrene and amino acrylic resin; 1 part by weight.

An image forming material free from the infrared rays absorbing toner was prepared as Comparative Example No. 7, and an image forming material with a black toner compounded by 10 parts by weight instead of the infrared rays absorbing toner was prepared as Comparative Example No. 8. The black toner contained carbon black, "Carbon Black #40 (produced by Mitsubishi Kasei Co., Ltd.)," by 5 parts by weight. Similarly, the predetermined image formed by the toner of Comparative Example Nos. 7 and 8 were irradiated with light, and the protrusion height and the color tone of the 3-D image were thereafter evaluated.

| | Content of Infrared Rays Absorbing Toner (Parts by Weight) | Protrusion Height (mm) | Color Tone |
|---|---|---|---|
| 9th Pref. Embodi. | 5 | 0.6 | Vivid red reproduced. |
| | 10 | 0.8 | Vivid red reproduced. |
| | 20 | 0.9 | Vivid red reproduced. |
| Compara. Example No. 7 | 0 | 0 | Vivid red |
| Compara. Example No. 8 | 1.0 Black Toner | 0.75 | Red uncleare with black |

As set forth in Table 5, the images were protruded sufficiently in the protrusion heights of from 0.6 to 0.9 mm and the color thereof was reproduced in the original color vividly and free from unclearness when the infrared rays absorbing toner of this preferred embodiment was compounded in the image forming materials by 5 parts by weight, 10 parts by weight, and 20 parts by weight.

On the contrary, the color of the image was reproduced vividly in red, but no image was protruded and no 3-D image was formed when the image was formed with the image forming material of Comparative Example No. 7. Further, the image was protruded by the protrusion height of 0.75 mm enabling a satisfactory 3-D image formation, but the color of the 3-D image was unclear with black when the image was formed with the image forming material of Comparative Example No. 8.

Tenth Preferred Embodiment

Similarly to the ninth preferred embodiment, this preferred embodiment is an example of an infrared rays absorbing toner superior in the infrared rays absorbing property.

The infrared rays absorbing toner of this preferred embodiment comprised the following components and tin oxide containing antimony as the infrared rays absorbing agent was compounded by 5 parts by weight therein.

The composition of the infrared rays absorbing toner was as follows:

Copolymer resin of styrene and acrylic resin; 100 parts by weight

The oxide containing antimony (infrared rays absorbing agent); 5 parts by weight Low molecular weight polypropylene; 2 parts by weight Copolymer resin of styrene and amino acrylic resin; 1 part by weight.

Three kinds of image forming materials were prepared by mixing infrared rays absorbing toners of this preferred embodiment by 5 parts by weight, 10 parts by weight and 20 parts by weight with a white toner having the following composition. A predetermined image was formed on the thermally expansible sheets with these image forming materials, and made into the 3-D image. The protrusion height and color tone of the 3-D image were then evaluated. The predetermined image was formed and made into the 3-D image with the same apparatuses and in the same manner as described in the section of "Sixth Preferred Embodiment".

The composition of the white toner was as follows:

Copolymer resin of styrene and acrylic resin; 100 parts by weight

Titanium oxide (white pigment); 5 parts by weight
Low molecular weight polypropylene; 2.5 parts by weight
Quarternary ammonium; 2 parts by weight
Copolymer resin of styrene and amino acrylic resin; 6 parts by weight.

An image forming material free from the infrared rays absorbing toner was prepared as Comparative Example No. 9, and an image forming material with the same black toner used for Comparative Example No. 8 compounded by 10 parts by weight instead of the infrared rays absorbing toner was prepared as Comparative Example No. 10. Similarly, the predetermined image formed by the toner of Comparative Example Nos. 9 and 10 were irradiated with light, and the protrusion height and the color tone of the 3-D image were thereafter evaluated.

TABLE 6

| | Content of Infrared Rays Absorbing Toner (Parts by Weight) | Protrusion Height (mm) | Color Tone |
|---|---|---|---|
| 10th Pref. Embodi. | 5 | 0.5 | Vivid white reproduced. |
| | 10 | 0.7 | Vivid white reproduced. |
| | 20 | 0.8 | Vivid white reproduced. |
| Compara. Example No. 9 | 0 | 0 | Vivid white |
| Compara. Example No. 10 | 10 Black Toner | 0.7 | Turned into gray. |

As set forth in Table 6, the images were protruded sufficiently in the protrusion heights of from 0.5 to 0.8 mm and the color thereof wa reproduced in the original color vividly and free from unclearness when the infrared rays absorbing toner of this preferred embodiment was compounded in the image forming materials by 5 parts by weight, 10 parts by weight, and 20 parts by weight.

On the contrary, the color of the image was reproduced vividly in white, but no image was protruded and no 3-D image was formed when the image was formed with the image forming material of Comparative Example No. 9. Further, the image was protruded by the protrusion height of 0.7 mm enabling a satisfactory 3-D image formation, but the color of the 3-D image was turned into gray when the image was formed with the image forming material of Comparative Example No. 10.

Eleventh Preferred Embodiment

This preferred embodiment is an example of a blue printing ink as the image forming material.

The blue printing ink of this preferred embodiment comprised 100 parts by weight of a conventional blue printing ink of the following composition, and 15 parts by weight of metal aluminum fine particles of the average particle diameter of 4 μm. The blue printing ink of this preferred embodiment was produced by compounding and uniformly dispersing the metal aluminum fine particles in the conventional blue printing ink.

The composition of the conventional blue printing ink was as follows:

Beta type phthalocyanine blue; 3% by weight
Rutile type titanium dioxide; 25% by weight
Copolymer resin of vinyl chloride and vinyl acetate; 20% by weight
Acrylic resin; 5% by weight
Cyclohexane; 10% by weight
Solvent #100 (aromatic hydrocarbon solvent); 33% by weight
Isophorone; 3% by weight
Dioctyl phthalate (DOP); 1% by weight.

A predetermined image was printed on the thermally expansible sheet ("3-D copy paper" produced by Minolta Jimuki Hanbai Co., Ltd.) having the thermally expansible layer comprising the thermally expansible microspheres by a screen printing method the blue printing ink of this preferred embodiment. The thickness of the blue printing ink deposition was maintained at 20 μm. After drying the blue printing ink of this preferred embodiment, the light was irradiated on the thermally expansible sheet with the light irradiation apparatus (a developing apparatus exclusively for this application produced by Minolta Jimuki Hanbai Co., Ltd.) having a halogen lamp of 900 W. The light irradiation has the blue printing ink generate heat to expand the thermally expansible microspheres. Only the image portions, formed with the blue printing ink of this preferred embodiment, on the thermally expansible sheet were protruded, and a 3-D image in blue was formed.

Experiment No. 1

Figure 6:
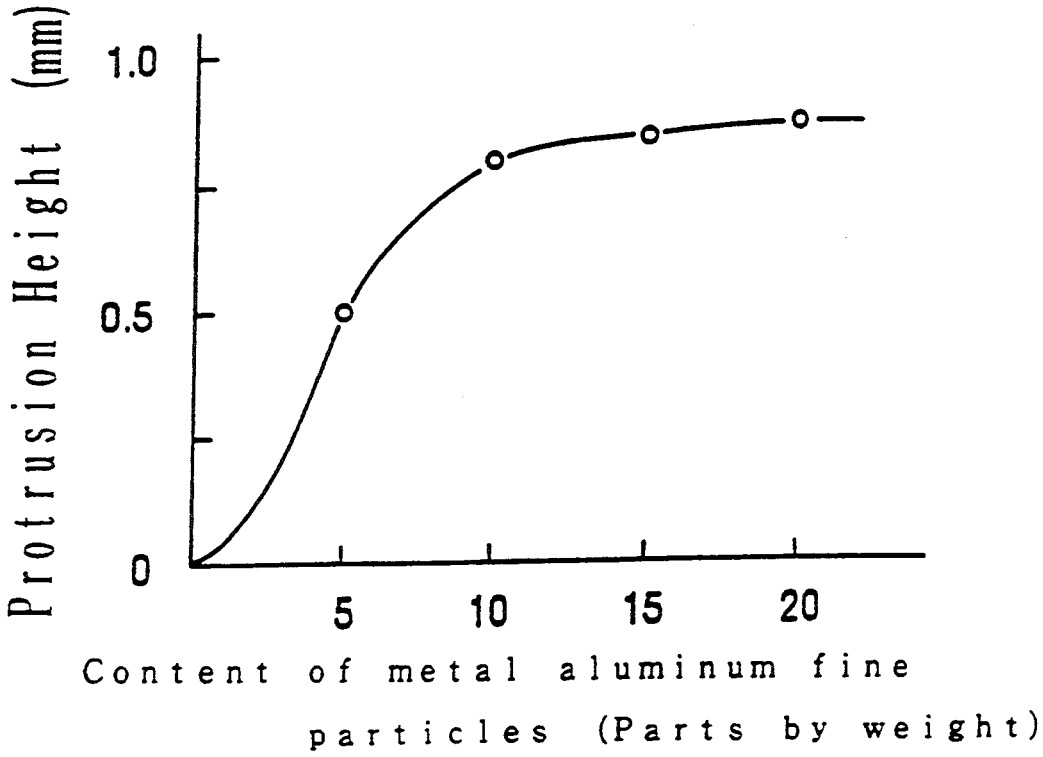
FIG. 6 is a graph showing the results of experiment No. 1 according to this invention and illustrating the relationship between the contents of metal aluminum fine particles and the protrusion height of 3-D image.

Another three kinds of blue printing inks were also prepared by varying the content of the metal aluminum fine particles from 5 parts by weight and 10 parts by weight to 20 parts by weight with respect to 100 parts by weight of the conventional blue printing ink in a manner similar to the preparation of the blue printing ink containing 15 parts by weight of the metal aluminum fine particles of the above-mentioned eleventh preferred embodiment. Similarly, 3-D images were formed with the three kinds of blue printing inks, and the protrusion heights of the 3-D images were examined. Further, the predetermined image was printed on the thermally expansible sheet with the conventional blue printing ink free from the compounding of the metal aluminum fine particles, and the light was irradiated on the thermally expansible sheet with the light irradiation apparatus to form a 3-D image. Other than the content of the metal aluminum fine particles, this experiment No. 1 was conducted under the same conditions as the above-mentioned eleventh preferred embodiment. FIG. 6 illustrates the result of this experiment No. 1.

As illustrated in FIG. 6, no protrusion occurred in the case of the conventional blue printing ink free from the metal aluminum fine particles, and no 3-D image was formed accordingly. The 3-D image of protrusion height of approximately 0.5 mm was formed in the case of the blue printing ink containing the metal aluminum fine particles by 5 parts by weight, and satisfies and achieves the requirements of the actual level application. Further, satisfactory 3-D images of the protrusion height of approximately 0.8 mm in all of the cases of the blue printing inks containing the metal aluminum fine particles by 10 parts by weight, 15 parts by weight and 20 parts by weight. However, no appropriate blue printing ink could be obtained when the metal aluminum fine particles was compounded by more than 20 parts by weight, because the flowability of the blue printing ink slightly deteriorated if such was the case.

The inventor of this invention has thus found that it is preferable to compound the metal aluminum fine particles by 5 to 20 parts by weight with respect to 100 parts by weight of the conventional blue printing ink.

Twelfth Preferred Embodiment

This preferred embodiment is an example of a yellow printing ink as the image forming material.

The yellow printing ink of this preferred embodiment comprised 100 parts by weight of a conventional yellow printing ink of the following composition, and 10 parts by weight of the metal aluminum fine particles of the average particle diameter of 4 μm. The yellow printing ink of this preferred embodiment was produced by compounding and uniformly dispersing the metal aluminum fine particles in the conventional yellow printing ink.

The composition of the conventional yellow printing ink was as follows:

Brilliant carmine "6E"; 5% by weight
Clay; 35% by weight
Ethyl hydroxyethyl cellulose (EHEC); 5% by weight
Pentaerythritol ester of rosin; 10% by weight
Mineral spirit; 20% by weight
Solvent #100 (aromatic hydrocarbon solvent); 20% by weight
Cellosolve; 5% by weight.

A predetermine image was printed on the thermally expansible sheet by a screen printing method similar to the eleventh preferred embodiment with the yellow printing ink of this preferred embodiment. The thickness of the yellow printing ink deposition was maintained at 20 μm. After drying the yellow printing ink of this preferred embodiment, the light was irradiated on the thermally expansible sheet with the above-mentioned light irradiation apparatus. Only the image portion, formed with the yellow printing ink of this preferred embodiment, on the thermally expansible sheet was protruded, and a 3-D image in yellow was formed.

Experiment No. 2

Figure 7:
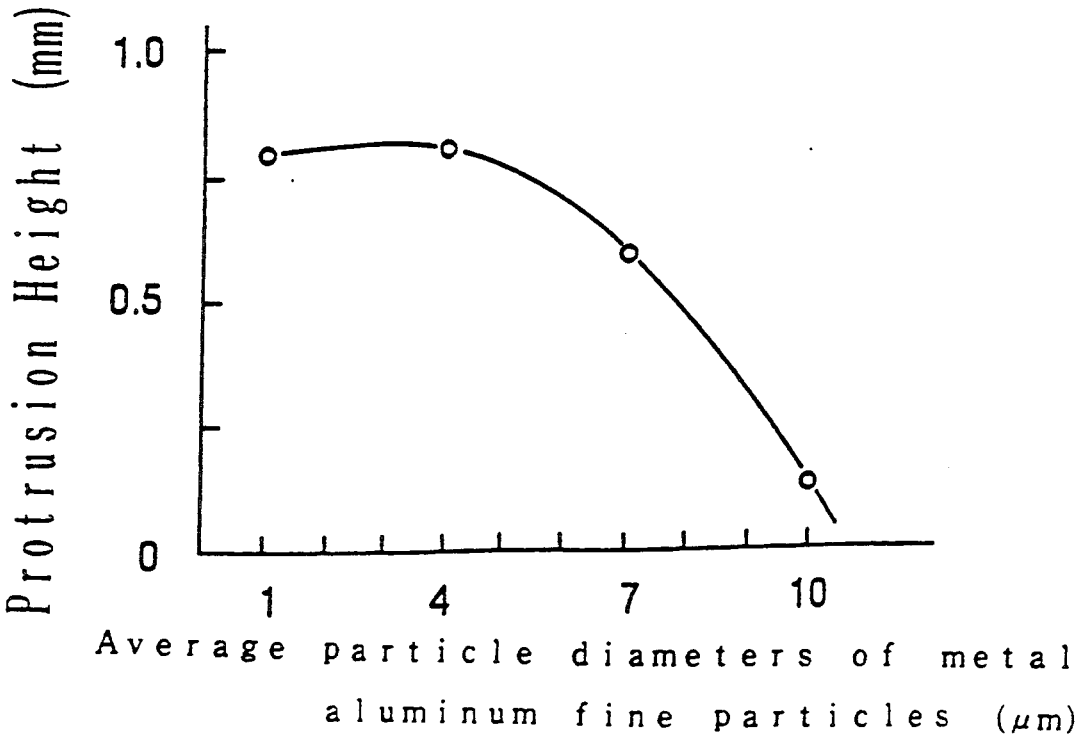
FIG. 7 is a graph showing the results of experiment No. 2 according to this invention and illustrating the relationship between the average particle diameters of metal aluminum fine particles and the protrusion heights of 3-D image.

Another three kinds of yellow printing inks were also prepared by varying the average particle diameter of the metal aluminum fine particles from 1 μm 7 μm and 10 μm. in a manner similar to the preparation of the yellow printing ink containing the metal aluminum fine particles of the average particle diameter of 4 μm. Similarly, 3-D images were formed with the three kinds of yellow printing inks, and the protrusion heights of the 3-D images were examined. Other than the average particle diameters of the metal aluminum fine particles, this experiment No. 2 was conducted under the same conditions as the above-mentioned twelfth preferred embodiment. FIG. 7 illustrates the result of this experiment No. 2.

As illustrated in FIG. 7, the 3-D image of the protrusion height of approximately 0.8 mm was formed in the case of the yellow printing ink containing the metal aluminum fine particles of the average particle diameter of 1 μm and 4 μm, and satisfactory 3-D images were formed Satisfactory 3-D image achieving the requirements of the practical application was formed in the protrusion height of approximately 0.6 mm was formed in the case of the yellow printing ink containing the metal aluminum fine particles of the average diameter of 7 μm. On the contrary, the protrusion height of the 3-D image is decreased to approximately 0.2 mm in the case of the yellow printing ink containing the metal aluminum fine particles of the average particle diameter of 10 μm. It is believed that the reduction in the protrusion height results from the reduced irregular reflection effect causing the reduced heat generation. The reduced irregular reflection is believed to occur when the average particle diameter of the metal aluminum fine particles exceeds one third (⅓) of the printing ink deposition thickness, i.e., 20 μm.

The inventor of this invention has thus found that it is preferable to compound the metal aluminum fine particles of 7 μm or less in the conventional printing ink in order to form satisfactory images on the thermally expansible sheet.

Having now fully described the invention, it will be apparent to one of ordinary skill in the art that many changes and modifications can be made thereto without departing from the spirit or scope of the invention as set forth herein.

What is claimed is:

1. A three-dimensional image forming method which comprises the steps of:

forming a desirable image on an image recording material which comprises a thermoexpansive material by using an image forming material including an infrared rays absorbing agent or metal aluminum fine particles, said infrared rays absorbing agent containing tin oxide, antimony oxide and/or indium oxide; and applying heat selectively by irradiating with light to the desirable image area formed on said recording material, whereby the desirable image-existing area is protruded to effect the three-dimensional image recording.

2. A three-dimensional image forming method according to claim 1, wherein said desirable image forming step comprises a step of forming the desirable image by a screen printing method with printing ink comprising a vehicle, a colorant and said infrared rays absorbing agent or metal aluminum fine particles.

3. A three-dimensional image forming method according to claim 2, wherein said screen printing method uses the printing ink including metal aluminum fine particles with 7 μm or less in mean particle size.

4. A three-dimensional image forming method according to claim 2, wherein said screen printing method uses the printing ink including metal aluminum fine particles at the content of 5~20 parts by weight on the basis of the vehicle of 100 parts by weight.

5. A three-dimensional image forming method according to claim 1, wherein said desirable image forming step comprises a step of forming the desirable image by an electrophotographic method with toner comprising said infrared rays absorbing agent or metal aluminum fine particles.

6. A three-dimensional image forming method according to claim 5, wherein said electrophotographic method uses toner comprising a binder resin, colorant and said infrared rays absorbing agent at the content of 0.5~5 parts by weight on the basis of the binder resin of 100 parts by weight.

7. A three-dimensional image forming method according to claim 1, wherein said desirable image forming step comprises a step of forming the desirable image by an electrophotographic method with toner mixed first particles including a binder resin and said infrared rays absorbing agent or metal aluminum fine particles, and second particles including a binder resin and colorant.

8. A three-dimensional image forming method according to claim 7, wherein said electrophotographic method uses toner comprising said first particles and said second particles, said first particles at the content of 5~20 parts by weight basis of the second particles of 100 parts by weight.

9. A three-dimensional image forming method according to claim 1, wherein the infrared rays absorbing agent includes tin oxide containing antimony or indium oxide containing tin.

10. A three-dimensional color image forming method which comprises the steps of:

forming a desirable color image other than black on an image recording material which comprises a thermoexpansive material by using a color image forming material including a colorant other than black and an infrared rays absorbing agent or metal aluminum fine particles, said infrared rays absorbing agent containing tin oxide, antimony oxide and/or indium oxide; and applying heat selectively by irradiating with light to the desirable color image area formed on said recording material, whereby the desirable color image-existing area is protruded to effect the three-dimensional color image recording.

11. A three-dimensional image forming method according to claim 10, wherein the infrared rays absorbing agent includes tin oxide containing antimony or indium oxide containing tin.

* * * * *